US005882848A

United States Patent [19]

Orr et al.

[11] Patent Number: 5,882,848

[45] Date of Patent: Mar. 16, 1999

[54] PHOTOGRAPHIC FIXING COMPOSITION

[75] Inventors: Zoe Orr, St Leonards on Sea; Jeffrey K. Green, Harrow, both of United Kingdom

[73] Assignee: Eastman Kodak Company, Rochester, N.Y.

[21] Appl. No.: 947,764

[22] Filed: Oct. 9, 1997

[30] Foreign Application Priority Data

Oct. 9, 1996 [GB] United Kingdom ..... 96210091

[51] Int. Cl.[6] ..... G03C 5/38

[52] U.S. Cl. ..... 430/455; 430/458

[58] Field of Search ..... 430/455, 458

[56] References Cited

U.S. PATENT DOCUMENTS

| | | | |
|---|---|---|---|
| 4,524,129 | 6/1985 | Kishimoto et al. | 430/455 |
| 5,275,923 | 1/1994 | Fyson | 430/455 |
| 5,298,373 | 3/1994 | Sasaoka et al. | 430/455 |
| 5,298,382 | 3/1994 | Toyoda et al. | 430/458 |
| 5,736,304 | 4/1998 | Rider et al. | 430/455 |

FOREIGN PATENT DOCUMENTS

| | | | |
|---|---|---|---|
| 0742481A1 | 11/1996 | European Pat. Off. . | |
| 05127323 | 5/1993 | Japan | G03C 5/38 |

*Primary Examiner*—Hoa Van Le
*Attorney, Agent, or Firm*—J. Lanny Tucker

[57] ABSTRACT

A fixing composition for processing a silver halide photographic material comprises a fixing agent, a sulfite stabilizer, an acid and a buffer. The composition has a pH greater than 5.4 and the buffer comprises at least 2.0 mol/l ammonium acetate.

9 Claims, 2 Drawing Sheets

PHOTOGRAPHIC FIXING COMPOSITION

FIELD OF THE INVENTION

The invention relates to a fixing composition for processing a silver halide photographic material.

BACKGROUND OF THE INVENTION

Exposed photographic materials, for example black-and-white photographic materials, are developed in a solution which reduces the exposed silver halide. The unexposed silver halide is then removed by treating the film or paper with a second solution known as a fixer which comprises a silver halide complexing agent, e.g., a thiosulfate. The fixer solution is acidic to ensure that any developer which is carried over from the development stage does not remain active. If the fixer solution is insufficiently acidic, the silver complexes formed on fixing can be reduced by the active developer to form dichroic fog.

It is essential that the pH of the photographic material is reduced rapidly throughout the emulsion layer when fixing takes place. In order to achieve this, a fixer which is buffered between pH 4 and 5 may be used. If the fixer is not buffered then either it will not be able to neutralize the alkali quickly in the emulsion or it will require a very low pH making it unsafe and unstable.

It is known to use an organic aliphatic acid as a buffer at a concentration between 1 and 3% in the working strength fixer solution as it will buffer in the region of pH 3 to 5. The acid most commonly used is acetic acid but other weak acids have also been used, particularly when they have less odor, e.g., tartaric, succinic and citric acids.

JP-A-5127323 describes a fixing composition having reduced odor comprising a fixing agent, e.g., ammonium thiosulfate, a stabilizer, e.g., sodium sulfite, a hardening agent, e.g., aluminum sulfate and acids including succinic or maleic acid.

The odor associated with fixers also appears to be due to the evolution of sulfur dioxide produced by the disproportionation of sulfite and the fixing agent in acid. The odor problem caused by the evolution of sulfur dioxide needs to be overcome.

Although it has been found that sufficiently raising the pH of the fixer can substantially reduce or eliminate the evolution of sulfur dioxide, the fixer loses its ability to effectively neutralize the alkaline solution carried over by the photographic material during processing. A typical fixer concentrate has a pH drop of about 0.1 unit on dilution with water to the working strength fixer. If the odor problem of the fixer concentrate is to be overcome by increasing pH, a much greater drop in pH is required on dilution with water.

SUMMARY OF THE INVENTION

The invention provides a fixing composition for processing a silver halide photographic material comprising a fixing agent, a sulfite stabilizer, an acid, and a buffer, wherein the composition has a pH greater than 5.4 and comprises at least 2.0 mol/l ammonium acetate as the buffer.

The release of sulfur dioxide from the fixing composition is inhibited and the resulting odor eliminated by using this invention. The high concentration of ammonium acetate produces an unexpectedly large drop in pH on dilution of the fixing composition with water to the working strength solution. The large increase in the concentration of ammonium acetate in the fixer causes the fixer, when stored in a concentrated form, to have a higher pH which improves keeping.

DETAILED DESCRIPTION OF THE INVENTION

Preferably, the buffer in the composition of this invention, is from 2.0 to 6.0, and more preferably from 2.5 to 3.5 mol/l, of ammonium acetate.

Preferably, the fixing agent is present in an amount from 0.4 to 4.0, and more preferably from 2.5 to 3.5 mol/l.

Fixing agents are water-soluble solvents for silver halide such as a thiosulfate (e.g., sodium thiosulfate, ammonium thiosulfate, and potassium thiosulfate), a thiocyanate (e.g., sodium thiocyanate, potassium thiocyanate and ammonium thiocyanate), a thioether compound (e.g., ethylenebisthioglycolic acid and 3,6-dithia-1,8-octanediol), a thioglycolic acid or a thiourea, an organic thiol, an organic phosphine, a high concentration of halide, such as bromide or iodide, a mesoionic thiolate compound, and sulfite. These fixing agents can be used singly or in combination. Thiosulfate is preferably used and ammonium thiosulfate, in particular, is used most commonly owing to the high solubility. Alternative counter-ions such as potassium, sodium, lithium, cesium as well as mixtures of two or more cations may be used.

Preferably, the sulfite stabilizer is present in an amount from 0.1 to 2.0, and more preferably from 0.2 to 0.5 mol/l.

Suitable sulfite stabilizers include sodium sulfite, potassium sulfite, ammonium sulfite, sodium bisulfite, potassium bisulfite, ammonium bisulfite, sodium metabisulfite, potassium metabisulfite, and ammonium metabisulfite.

Preferably, the acid in the composition is an organic aliphatic acid, e.g., acetic, tartaric, succinic, maleic and citric acids. In a particularly preferred embodiment, the acid comprises acetic acid.

Other components of the fixing composition may be preservatives and sequestering agents.

The fixing composition may have a pH from 5.4 to 6.0, and preferably from 5.4 to 5.6.

A detailed description of fixing compositions and their use is found, for example, in *Research Disclosure*, Number 365, September 1994, Item 36544 published by Kenneth Mason Publications Ltd. (hereinafter referred to as *Research Disclosure*) pages 539–540.

Dilution of a fixing composition in accordance with the invention to normal working strength results in a significant drop in the pH of the solution, for example, a drop of between 0.2 and 0.5 units.

The invention is further illustrated by way of example as follows.

EXAMPLE 1

A fixer concentrate in accordance with the invention was prepared having the following composition.

Photographic Fixer of the invention:

| | |
|---|---|
| Water | 113 g |
| Acetic acid (90% solution) | 105 g |
| Ammonium acetate | 250 g |
| Ammonium thiosulfate/sulfite solution | 750 g |

-continued

| | |
|---|---|
| Sodium sulfite | 10 g |
| Boric acid | 25 g |

Figure 1:
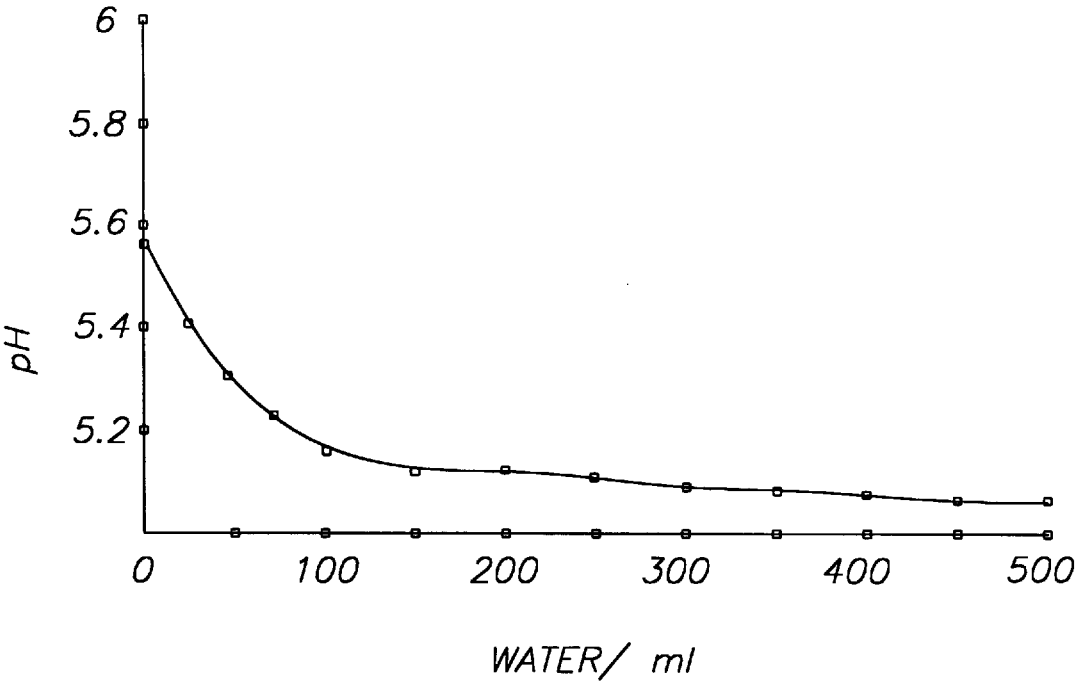
FIGS. 1 to 4 are graphs showing the effect on pH of diluting fixer concentrates referred to in the Examples below.

The pH of the concentrate was 5.5. Diluting the concentrate to provide a working strength solution reduced the pH to 5. The results of dilution are shown in FIG. 1 which is a plot of dilution versus pH.

For comparison, a conventional fixer concentrate was prepared having the following composition.

Conventional Black-and-White Photographic Fixer Formula:

| | |
|---|---|
| Ammonium thiosulfate/sulfite solution | 1000 g |
| Water | 95 g |
| Sodium metabisulfite | 25 g |
| Boric acid | 40 g |
| Sodium acetate | 120 g |
| EDTA | 0.1 g |

Figure 2:
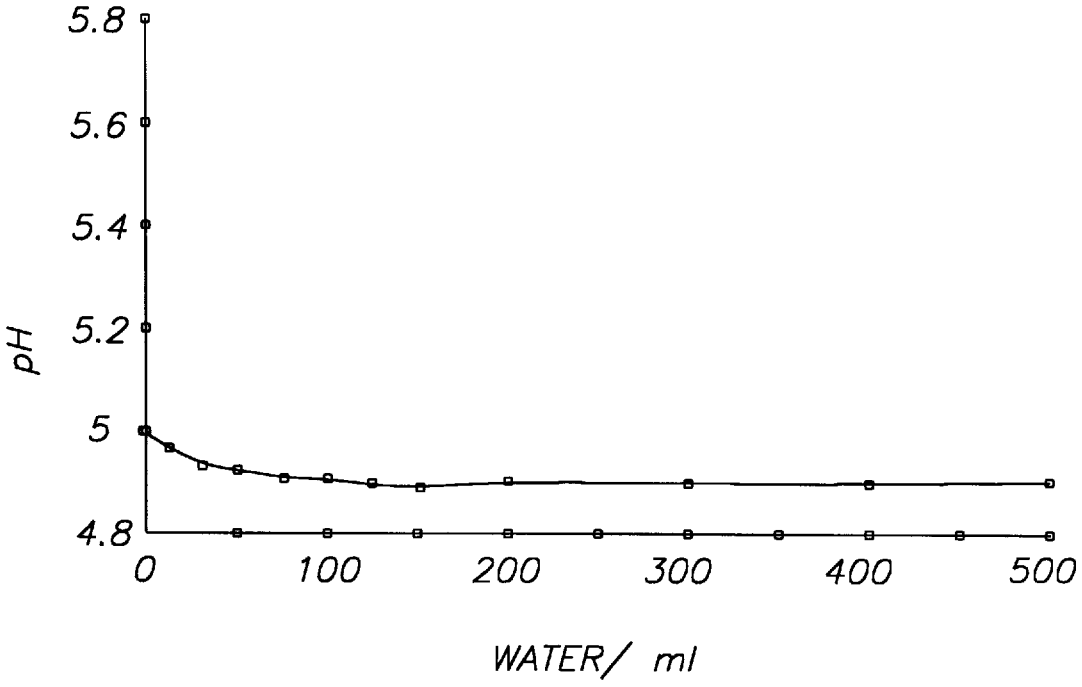

The pH of the concentrate was 5.1. Diluting the concentrate to provide a working strength solution reduced the pH to 5. The results of dilution are shown in FIG. 2 which is a plot of dilution versus pH.

EXAMPLE 2

Figure 3:
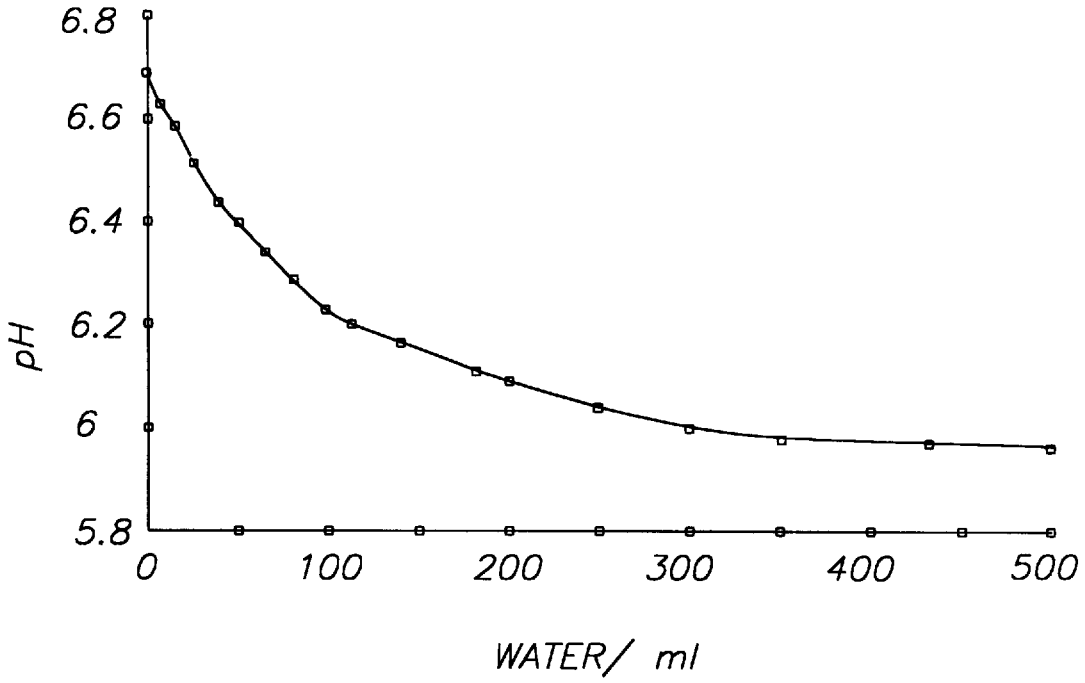

Ammonium acetate was added to the conventional black-and-white fixer described in Example 1 at a level of 500 g/l. The solution was diluted with water and the pH of the solution was measured as it was diluted. The resulting curve is shown in FIG. 3.

A significant drop in pH occurred on dilution.

EXAMPLE 3

Figure 4:
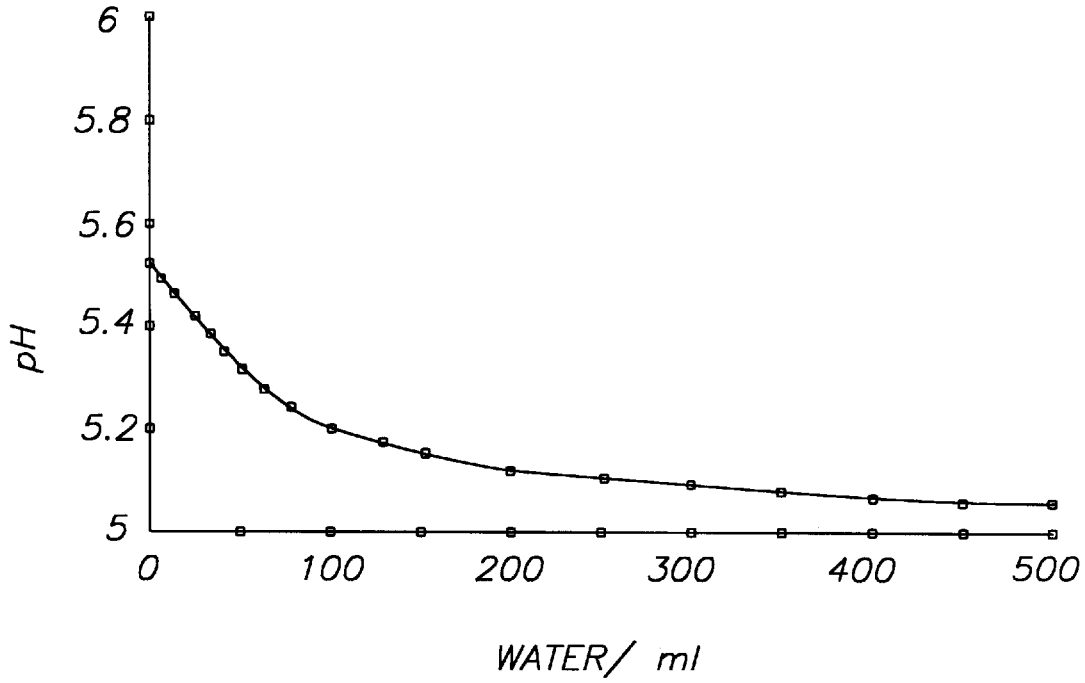

Ammonium acetate was added to the conventional black-and-white fixer described in Example 1 at a level of 500 g/l. The pH of the solution was adjusted to 5.5 from 6.8 with sulfuric acid. The solution was diluted with water and the pH of the solution was measured as it was diluted. The resulting curve is shown in FIG. 4.

A significant drop in pH occurred on dilution.

EXAMPLE 4

A fixing composition in accordance with the invention was prepared having the following composition

| | |
|---|---|
| Acetic acid (90% solution) | 105 g |
| Ammonium acetate | 250 g |
| Ammonium thiosulfate/sulfite solution | 600 g |
| Sodium sulfite | 10 g |

-continued

| | |
|---|---|
| Boric acid | 25 g |
| Ammonium thiocyanate | 50 g |
| Water to make 1 liter. | |

The pH of the composition was 5.71. On dilution with water (1 part fixer and two parts water) The pH dropped to 5.36, i.e., a drop of 0.35 units.

EXAMPLE 5

A fixing composition in accordance with the invention was prepared having the following composition

| | |
|---|---|
| Acetic acid (90% solution) | 105 g |
| Ammonium acetate | 250 g |
| Ammonium thiosulfate/sulfite solution | 600 g |
| Sodium sulfite | 10 g |
| Boric acid | 25 g |
| Ammonium thiosulfate | 50 g |
| Water to make 1 liter. | |

The pH of the composition was 5.5. On dilution with water (1 part fixer and two parts water) The pH dropped to 5.14, i.e., a drop of 0.36 units.

The invention has been described in detail with particular reference to certain preferred embodiments thereof, but it will be understood that variations and modifications can be effected within the spirit and scope of the invention.

We claim:

1. A fixing composition for processing a silver halide photographic material comprises a fixing agent, a sulfite stabilizer, an acid, and a buffer wherein said composition has a pH greater than or equal to 5.4, and comprises at least 2.0 mol/l ammonium acetate as said buffer.

2. The composition of claim 1 comprising from 2.0 to 6.0 mol/l of ammonium acetate.

3. The composition of claim 1 comprising said fixing agent in an amount from 0.4 to 4.0 mol/l.

4. The composition of claim 1 wherein said fixing agent is ammonium thiosulfate or ammonium thiocyanate.

5. The composition of claim 1 wherein said sulfite stabilizer is present in an amount from 0.1 to 2.0 mol/l.

6. The composition of claim 1 wherein said acid is an organic aliphatic acid.

7. The composition of claim 6 wherein said acid is acetic acid.

8. The composition of claim 1 having a pH of from 5.4 to 6.0.

9. The composition of claim 1 comprising from 2.5 to 3.5 mol/l of said buffer, from 2.5 to 3.5 mol/l of said fixing agent, from 0.2 to 0.5 mol/l of said sulfite stabilizer, and having a pH of from 5.4 to 5.6.

* * * * *